United States Patent [19]

Ramachandran et al.

[11] Patent Number: 4,721,581

[45] Date of Patent: Jan. 26, 1988

[54] ALKYL ETHOXYLATE SULFATE DETERGENT LAUNDRY BARS AND PROCESSES FOR MANUFACTURE THEREOF

[75] Inventors: Pallassana N. Ramachandran, Robbinsville; Patrizia Barone, Piscataway, both of N.J.

[73] Assignee: Colgate-Palmolive Company, New York, N.Y.

[21] Appl. No.: 836,908

[22] Filed: Mar. 6, 1986

[51] Int. Cl.[4] ..... C11D 17/00

[52] U.S. Cl. ..... 252/135; 252/134; 252/140; 252/174; 252/174.14; 252/174.21; 252/174.25; 252/531; 252/DIG. 16

[58] Field of Search ..... 252/134, 135, 531, 139, 252/140, 154, 163, 174, 174.25, DIG. 16, 174.21, 174.14

[56] References Cited

U.S. PATENT DOCUMENTS 4,011,170 3/1977 Pickin et al. ..... 252/134
4,472,287 9/1984 Ramachandran et al. ..... 252/174.25
4,515,707 5/1985 Brooks ..... 252/531
4,543,204 9/1985 Gervasio ..... 252/DIG. 16

*Primary Examiner*—Paul Lieberman
*Assistant Examiner*—Hoa Van Le
*Attorney, Agent, or Firm*—John A. Stemwedel; Herbert S. Sylvester; Murray M. Grill

[57] ABSTRACT

Detergent laundry bars of acceptable mildness, foaming properties and processing characteristics are described which are based on built higher fatty alcohol ethoxylate sulfate detergent and which contain bentonite, which acts as a bodying agent for the laundry bars, facilitating production thereof, and contributes fabric softening properties to laundry washed with such laundry bar. When the bentonite is omitted or is replaced by water insoluble filler, such as calcium carbonate powder, bars made are not of acceptable hardness and such compositions are not satisfactorily processable in conventional soapmaking apparatuses.

Also described are processes for converting aqueous solutions of higher fatty alcohol ethoxylate sulfate detergent to solid form by treatment with bentonite, and for making detergent laundry bars from such solidified detergent.

14 Claims, No Drawings

ALKYL ETHOXYLATE SULFATE DETERGENT LAUNDRY BARS AND PROCESSES FOR MANUFACTURE THEREOF

This invention relates to detergent laundry bars. More particularly, it relates to a built synthetic organic detergent laundry bar in which the detergent is primarily higher fatty alcohol ethoxylate sulfate anionic detergent or a mixture of such detergents. Such bars, containing such detergent(s), builder, bentonite and water, are superior in important characteristics to bars of the same formula except for the replacement of the bentonite with other water insoluble fillers or bodying agents, such as calcium carbonate powder. Such characteristics in which the invented bars are superior include processing ease, bar hardness and fabric softening. The bars made are also of satisfactory foaming and detergent properties for hand washing laundry, and are acceptably mild to the skin of the user. The bars made are also resistant to cracking, chipping, breaking or other damage on storage and handling, unlike bars of the same formula except for the replacement of the ethoxylate sulfate detergent with other synthetic organic detergent, such as sodium higher fatty alcohol sulfate.

Soap bars have for long been employed for washing the human body and for "doing laundry". Before the advent of washing machines dictated the employment of detersive materials in powder, disintegrable briquette, or liquid forms, laundry was washed with "laundry soap" bars made from suitable soaps of higher fatty acids, such as sodium soaps of mixed tallow and rosin fatty acids. Such laundry soap bars were especially suitable for being rubbed onto badly stained or soiled portions of fabric being laundered, as on a washboard, to deposit a high concentration of the soap on the soiled area, and they provided mechanical means for applying energy to such surfaces to assist in removing the stains and soils.

Despite the fact that after introduction of synthetic organic detergents and washing machines the amount of soap employed for laundry use diminished greatly, with the soap-based laundry bars being replaced mostly by synthetic organic detergent compositions in powder, liquid or other suitable form, laundry soaps and detergents in bar form are still preferred by some consumers, especially in certain areas of the world. Several detergent laundry bars based on alkylbenzene sulfonate detergents have been successfully marketed. They have been characterized as the equivalents in washing abilities of powdered laundry detergents based on similar alkylbenzene sulfonates, and are considered by many consumers to be more convenient to use. To use them does not require a washing machine and, as was previously indicated, the bar form of the product allows it to be used in such manner that a comparatively high concentration of detersive material may be readily applied to a heavily stained or soiled area with accompanying physical force or energy as on a washboard, so as more readily to loosen and remove such soil or stain.

Although branched chain higher alkylbenzene sulfonate detergents, such as sodium dodecylbenzene sulfonate (the dodecyl is often highly branched propylene tetramer but can be linear too), make satisfactory detergent laundry bars, such detergents have sometimes been found to be environmentally, ecologically, or economically unacceptable and accordingly, efforts have been made to formulate detergent laundry bars based on other synthetic organic detergents which would be less objectionable or would be unobjectionable in such respects. Among candidates for use as such a detergent are the higher fatty alcohol (or alkyl) sulfates, especially the sodium salts, which are biodegradable and have been successfully employed in various detergent compositions. However, such higher fatty alkyl sulfates had been found to be susceptible to becoming damaged during handling after storage and before final use. It was observed that they appeared to change physical properties after manufacture and became prone to excessive breakage during ordinary shipment. Additionally, such products were often not as satisfactorily foaming as analogous laundry bars based on alkylbenzene sulfonate detergents. One solution to breakage problems is disclosed in U.S. Pat. No. 4,543,204,which teaches the incorporation of higher fatty acids in the bar formula to counteract the tendency of higher fatty alcohol sulfate laundry bars to crack or break during storage and shipment, and also mentions that the fatty acid improves foaming characteristics of the fatty alcohol sulfate bars. However, that requires the addition of material to the formula which is not a detergent or a builder, and which may be comparatively expensive. The present invention is of a detergent laundry bar of acceptable laundry bar properties (foaming, detergency, processing ease and mildness), which is environmentally acceptable (biodegradable), and which does not crack or break to an excessive extent on storage and during shipment.

In accordance with the present invention a built synthetic organic detergent laundry bar comprises 15 to 40% of higher fatty alcohol ethoxylate sulfate, 10 to 50% of builder(s) for the sodium higher fatty alcohol ethoxylate sulfate, 5 to 40% of bentonite, and 5 to 20% of water, which water includes water removable from any hydrate components of such detergent laundry bar when said bar is subjected to heating at 105° C. for two hours. Preferably the detergent laundry bar comprises 20 to 35% of sodium higher fatty alcohol ethoxylate sulfate in which the higher fatty alcohol is of 10 to 18 carbon atoms and the ethoxylate moiety is of 2 to 10 ethoxy groups, 5 to 35% of sodium tripolyphosphate, 0 to 25% of sodium carbonate, 0 to 10% of sodium silicate, 10 to 25% of bentonite and 8 to 15% of water. Also within the invention are processes for manufacturing a detergent laundry bar of the invention and for converting an aqueous solution or solution/dispersion of ethoxylate sulfate detergent to solid or semi-solid form, using bentonite.

The closest prior art known to applicants includes disclosures of various synthetic organic detergents, such as sodium alkyl sulfate and sodium alkylbenzene sulfonate, as the primary detergents in built detergent laundry bars which could include other synthetic organic detergents and adjuvants, such as clays, including bentonite. U.S. Pat. No. 4,515,707 discloses neutralization of ethoxylated fatty alcohol sulfuric acid with dry sodium carbonate powder in the presence of powdered sodium tripolyphosphate. The product resulting, sodium fatty alcohol ethoxylate, with sodium tripolyphosphate and sodium bicarbonate, is a free-flowing powder and is useful as a component of detergent laundry bars. Such bars may also contain other components in dry, powdered form, such as calcium carbonate and talc. However, bentonite is not mentioned in the patent, and the theory and operation of the patent process are different from those of the present application. According to the patent, the neutralization reaction is carried out using anhydrous detergent acid and the presence of water is avoided entirely in producing the freely flowable detergent salt. On the contrary, applicants start with commercially available aqueous solutions or solution/dispersions of the detergent salts and convert these to solid or semi-solid form with bentonite powder, which also contributes other desirable properties to the detergent laundry bars made from the solid or semi-solid intermediate product. U.S. Pat. No. 4,543,204 describes a built higher fatty alcohol sulfate detergent laundry bar containing higher fatty acid, and suggests replacement of some of the alcohol sulfate of a working example with alcohol ethoxylate sulfate. U.S. Pat. No. 4,472,287 discloses that a particulate fabric softening detergent composition may comprise a mixture of spray dried detergent composition beads (which can include ethoxylate sulfate detergent) and an agglomerate of bentonite and insoluble soap, and at column 14, lines 31–34 the compacting of such mixtures to briquettes is suggested. None of the prior art known to applicants is considered by them to anticipate their invention or to make it obvious.

The higher fatty alcohol ethoxylate sulfates, which may be based on natural or synthetic primary or secondary alcohols, but preferably are based on primary natural alcohols, will normally be of a higher fatty alcohol of 10 to 18 carbon atoms, with the ethoxylate moiety being of 1 to 20 ethoxy group(s). The cation will normally be sodium but others, such as triethanolamine, potassium, ammonium, magnesium and calcium,can also be employed, preferably in minor proportion, with the sodium detergent normally being more than 50%, and preferably being all or substantially all of the ethoxylate sulfate present.

Other synthetic organic anionic detergents of the sulfated and/or sulfonated types (and in some case nonionic and/or amphoteric detergents) may also be present in the laundry bar as secondary detergents but the total amounts of such secondary detergents will normally be only minor, with respect to the higher fatty alcohol ethoxylate sulfates. Among the secondary detergents those which are preferred, especially when biodegradability is desirable, include higher fatty alcohol sulfates of 10 to 18 carbon atoms in the higher fatty alcohol moieties, higher fatty acid monoglyceride sulfates of 10 to 18 carbon atoms in the fatty acyl moieties, the paraffin sulfonates, olefin sulfonates and alpha-sulfo-higher fatty acid methyl esters. Sometimes some branched and linear alkylbenzene sulfonates of 10 to 18 carbon atoms in the lipophilic groups thereof, may be present, with the more biodegradable members of the alkylbenzene sulfonate class being more preferred. The higher fatty acid soaps may also be incorporated in these products, usually in minor proportions, and mixtures of the various secondary detergents with each other and/or with soaps and/or the principal higher fatty alcohol ethoxylate sulfate detergents may be utilized. Higher fatty acid lower alkanolamides, such as monoethanolamides and diethanolamides, may also be included in the present detergent laundry bars but although such possess some detersive properties they will usually be employed because of their functions as improvers of other laundry bar properties, such as resistance to breakage, foam quality. The various secondary detersive components of the laundry bars will normally be employed as their water soluble salts, and preferably will be sodium salts. Mixtures of different types of salts, such as those mentioned previously for the ethoxylate sulfates, may be employed, as may be mixtures of the detergents. Normally the higher fatty acyl or alkyl (or alkanol) groups in the detergents will be mixtures but essentially pure starting materials may also be employed so that the detergent, whether a primary or secondary detersive component of the products, may include a lipophilic group which can be of essentially the same chain length as that of the ethoxylate sulfate.

The principal detergent, the higher fatty alcohol ethoxylate sulfate, is preferably of a fatty alcohol which is essentially saturated and of a carbon atom chain length within the 10 to 18 carbon atoms range. Usually the ethoxylate sulfates are those wherein the fatty alcohol component, which may be pure or a mixture (mixtures being more common), is essentially saturated and is of carbon content within or averaging within the 10 to 18 carbon atoms range, preferably 12 to 16, and more preferably 12 to 15 (and often most preferably derived from coconut oil [coco]). The fatty alcohol component of the ethoxylate sulfate may be obtained from other natural sources, too, such as palm kernel oil, or may be synthesized, as from petroleum products. Sometimes there will be employed what is characterized as a broad cut of fatty alcohols covering the $C_{10-18}$ range, such as one analyzing about 0.3% of $C_{10}$, 48 to 58% of $C_{12}$, 19 to 24% of $C_{14}$, 9 to 12% of $C_{16}$, and 5 to 13% of $C_{18}$ fatty alcohols. While saturated alcohols are highly preferred as sources for the alcohol-derived moiety of the present detergent, some unsaturated alcohols, normally less than 20% of the total content may also be present. The ethoxy chain of the ethoxylate sulfate will usually be of 1 to 20 ethoxy group(s), preferably being of 2 to 10 ethoxy groups, more preferably being of 2 to 5 ethoxy groups, and most preferably of 3 or about 3 ethoxy groups.

The higher fatty alcohol ethoxylate sulfate employed is normally initially in the form of an aqueous solution or a solution/dispersion (in which some detergent or other material may be present in solid form, usually as fine particles). Preferably the ethoxylate sulfate detergent starting material will be an aqueous solution of the sodium salt, with the concentration of the detergent being such that it constitutes a major proportion of the solution, preferably being 60 to 80% thereof and more preferably 65 to 70% thereof, e.g., 70%.

Because the aqueous solution or solution/dispersion of ethoxylate sulfate does not make a bar of satisfactory hardness and does not process well in equipment normally employed for manufacturing soap and/or detergent bars (amalgamators, mills, plodders, extruders, cutters and presses), bentonite is an essential component of the invented products and, when admixed with the ethoxylate sulfate solution or dispersion, significantly improves the processability thereof and of the detergent laundry bar composition. The bentonite employed may be any suitable bentonite but usually will be a swelling bentonite. It will normally be utilized in powdered form, with all or substantially all (over 95%) passing through a No. 200 sieve, U.S. Series, and sometimes it may be even more preferable to have the bentonite more finely divided, so that a major proportion thereof passes through a No. 325 sieve, too. While it is preferred to employ swelling bentonites of the type known as Wyoming bentonite, other bentonites may also be utilized, including those mined in Canada, Italy, Spain, U.S.S.R. and in states of the United States other than Wyoming (principally Idaho, Mississippi and Texas).

The bentonites preferably employed are sodium or potassium bentonites and are mined as such. However, bentonites of low or negligible swelling capacities may be converted or activated to increase such capacity by treatment with alkaline materials, such as aqueous sodium carbonate solution, in a manner known in the art. Mixtures of swelling and non-swelling bentonites may be employed but it is considered that the more non-swelling bentonite that is present the less effective the fabric softening activity of the product and the more limited the binding, hardening and processing-improving properties of the bentonite. Among various suppliers of satisfactory bentonites are American Colloid Corporation and Georgia Kaolin Company. A product of Georgia Kaolin Company that has been found to be satisfactory is their Mineral Colloid No. 101, which may be employed alone and/or mixed with their GK-129 clay. American Colloid Corporation supplies a bentonite clay designated AEG 325, which may be employed alone and/or with their Kaolin No. 6 tile clay. In Italy a suitable activated clay is sold as Laviosa AGB and in the Philippines a bentonite clay sold under the tradename Filgel has been found to be useful in the practice of this invention.

Various water soluble builder salts for the ethoxylate sulfate detergent, usually as sodium builder salts, may be incorporated in the invented laundry bars. Of these the most important are the phosphates, particularly the polyphosphates, such as sodium tripolyphosphate and sodium pyrophosphate. Sodium orthophosphate may be employed, usually in minor proportion with respect to the polyphosphate(s). Other water soluble builder salts, of the chelating or precipitating types, inorganic and organic, may also be used, such as sodium carbonate, sodium silicate, borax, sodium bicarbonate, and sodium sesquicarbonate. Other builders, including organic builders, such as trisodium nitrilotriacetate (NTA) sodium polyacrylate, sodium citrate and sodium polyacetal carboxylate may be used, as may be other water soluble salts of the corresponding acids.

In addition to the water soluble builders, some water insoluble builders may also be employed, such as detergent building,calcium ion exchanging zeolites, including hydrated zeolites A, X and Y, e.g., Zeolite 4A containing about 20% of water of hydration. Such materials also may act as bodying agents and can improve processability,but while such other desirable properties can be of some importance, herein the zeolites will be considered as builders, and will be included in the proportions specified for builders.

Various mixtures of builders may be employed to make the laundry bars of this invention but it is preferable that the primary builder be pentasodium tripolyphosphate, more preferably hydrated and high in type I crystal form. It has been found that such hydrated polyphosphate, which preferably is at least partially hydrated during working in with the other detergent laundry bar components, contributes, with the bentonite, to the improvement of the ease of working, strength and uniform extrusion of the present laundry detergent bars. Sodium carbonate has bodying properties too, as does borax.

Water insoluble particulate material components of the present bars, hereafter usually referred to as bodying agents, although they may also perform other functions in the bars, are not considered to be essential components of the present compositions but they can contribute to the formation of a firm, yet processable laundry bar, and can help to regulate the release of detergent from the bar during use. While any of many insoluble materials, usually inorganic and mineral, may be employed, such as clays, talc, calcium silicate, magnesium silicate, calcium sulfate, silica, calcium phosphate, and calcium carbonate, the most important of such materials is calcium carbonate, and talc is usually considered to be the next best such bodying agent. Talc, a natural hydrous magnesium silicate, in conjunction with the other components of the bar, is especially useful for promoting processing ease, improving the feel of the laundry bar, helping to improve its storage characteristics and making a better foam or lather.

The bentonite calcium carbonate and talc, and the other insoluble (and often soluble materials, too) will normally be in the finely divided form, often with all or substantially all, e.g., over 99%, passing through a No. 200 sieve (U.S. Sieve Series) and sometimes through a No. 325 sieve.

Sodium sulfate may also be present in the present compositions, as a filler and bodying agent, in proportion in the range of 0 to 20%, preferably 1 to 10%, if present.

Various adjuvants may be employed in the present detergent laundry bars for their individual desirable effects. Among such adjuvants are: foam stabilizers, such as higher fatty acid lower alkanolamides, e.g., lauric myristic diethanolamide; binders, such as starches and modified starches; plasticizers, such as higher fatty alcohols, e.g., cetyl alcohol, lauryl alcohol; colorants, such as dyes and pigments, e.g., Polar Brilliant Blue dye and ultramarine blue pigment; fluorescent brighteners, such as stilbene brighteners; whitening agents, such as titanium dioxide (anatase); antioxidants, e.g., benzohydroxytoluene; perfumes; anti-redeposition agents, e.g., sodium carboxymethyl cellulose (which also may have binding properties); enzymes, e.g., protease, amylase; bactericides; fungicides, and solvents.

In addition to the above components water will be present in the laundry bar. Normally sufficient water will be available, from the composition components, as supplied, especially from the ethoxylate sulfate solution. However, if anhydrous detergent is employed or if the components do not contain sufficient water to plasticize the composition satisfactorily for processing, and/or to have enough water in the final bar, water may be added. While it is preferred to employ deionized water, tap water or city water may be utilized, preferably with the hardness content thereof being no more than 200 parts per million, as calcium carbonate, and more preferably with such hardness being less than 100 or 50 p.p.m. The water serves as a mutual solvent and plasticizing agent for various components of the detergent bar and facilitates hydration of some of the hydratable materials, such as sodium polyphosphate, sodium pyrophosphate, sodium carbonate, sodium sulfate, bentonite and starch (when present). In conjunction with detergents, binders, bodying agents and/or hydratable salts present, plus some adjuvants, the water tends to facilitate processing, such as milling and plodding, and helps to maintain the detergent bar sufficiently strong so that it will resist cracking and breakage on shipment after manufacture and storage. Higher fatty acid, if present, may inhibit evaporation of moisture from the laundry bar, thereby helping to maintain the bar in stronger condition on storage. Alkanolamides and fatty alcohols, if present, may also have such an effect.

The proportions of the various components in the final detergent are approximately the same as those in the mixture of materials being formulated (usually in an amalgamator) for milling and plodding because relatively little moisture is lost in such operations. Normally the moisture loss will be between 0.5 and3%, and most of the time the loss will be between 1 and 2%, e.g., 1.5%. If it appears during the mixing or subsequent operations that the composition is not sufficiently plasticized, due to low water content or removal of free water by gelation and hydration, additional water may be employed, which is usually added to the amalgamator, sigma-type mixer or other suitable mixing or blending device, with the various other components of the detergent laundry bar.

The percentage of sodium higher fatty alcohol ethoxylate sulfate in the bar will usually be 15 to 40%, preferably 20 to 35% or 25 to 30%. Usually no other detergent will be present but sometimes up to 5 or 10% of an auxiliary detergent may be employed, e.g., sodium higher fatty alcohol, e.g., coco alcohol sulfate or sodium alpha-sulfo-coco fatty acid methyl ester. The bentonite content will usually be in the range of 5 to 40%, preferably being 10 to 25%, more preferably being 10 to 20%, and most preferably being 13 to 17%, e.g., 15% or about 15%. The proportion of bentonite will be a bodying proportion, but sometimes an additional bodying agent may also be present. The total percentage of such supplemental bodying agent will usually be 0 to 30%, preferably 10 to 25%. The builder content will normally be in the range of 10 to 50%, preferably 15 to 35%, more preferably 20 to 30%, e.g., about 22%, and it will often be preferred that the builder be inorganic water soluble salt, such as a mixture of sodium tripolyphosphate and sodium carbonate, with sodium silicate, usually of $Na_2O:SiO_2=1:2.4$, being optional. The range of water content of the bar, which includes water removable from any hydrate components when the bar is subjected to heating at 105° C. for two hours, following a normal moisture analysis procedure, will normally be 5 to 20%, preferably 8 to 15%, more preferably 10 to 15%, and sometimes most preferably 11 to 14%, e.g., 12% or about 12%. With respect to individual builders and bodying agents it may be preferred that the builders include 5 to 35% of sodium tripolyphosphate, 0 to 25% of sodium carbonate and 0 to 10% of sodium silicate, more preferably 10 to 20%, 5 to 20%, and 0 to 5%, respectively, e.g., about 12% of sodium tripolyphosphate, about 10% of sodium carbonate and no sodium silicate. The supplementing bodying agent contents, preferably water insoluble powder(s), will preferably be 5 to 20% of calcium carbonate and 0 to 15% of talc, more preferably 8 to 15% of calcium carbonate and 5 to 15% of talc, e.g., about 11% of each.

Adjuvant content will usually be limited to 5% and preferably will be limited to 3%. Thus, the proportion of adjuvants present may be in the range of 0.5 to 3 or 5%, e.g., about 1 or 2%.

The invented detergent laundry bars can be processed with available equipment of types used for manufacturing soap and detergent bar products. Initially, a heavy duty amalgamator or mixer, such as one equipped with sigma-type blades, or one equipped with counter-rotating paddle type agitators, is used to mix the various components, many of which are powdered but some of which are in liquid state, sometimes as aqueous solutions (the ethoxylate sulfate, for example). The order of addition of the various components of the laundry bars is not considered to be important but reasonable care will be taken to prevent complete or premature hydration of the phosphate (and any other hydratable components which desirably hydrate during working of the composition) and any excessive lumping which could occur in the mixing process. The usual mixing time is from 2 to 15 minutes but it can take from one minute to an hour. The mixed product will desirably be in separate solid form (or a divisible mass) at about room temperature and will be charged, preferably by means of a multi-worm transfer conveyor (preferably equipped with cooling means), to a multi-rolled mill, such as a five-roll Lehmann mill of the soap mill type. The mill will be equipped with means for heating and cooling,and normally cooling will be employed to maintain the ribbon temperature from the mill within the temperature range of about 30° to 40° or 45° C. Various ribbon and chip thicknesses may be employed but usually such thicknesses will be in the range of 0.1 to 1 mm., preferably 0.2 to 0.4 or 0.5 mm. However, other thicknesses may be milled, too, depending on particular formulations, so long as the composition is satisfactorily homogenized on the mill and providing that any coarse particles that may be present are pulverized so that the finished product is not objectionably gritty.

The milled chips or milled material in other form is then conveyed to a double stage vacuum plodder, operating under a vacuum e.g., 600 to 740 millimeters of mercury vacuum, in which any entrapped air is evacuated. The mass of laundry detergent composition is worked in the plodder and is extruded from it as a bar. The plodder is equipped with a heated nozzle which softens the composition immediately prior to extrusion, allowing the production of a uniform and homogeneous bar. Such bar may be cut to length and impressed with a product brand name by means of a combination of rotary cutter and imprinter, or it may be cut to lengths, called blanks, and may be stamped to shape in a press. Before pressing, the blanks may be cooled in a cooling tunnel. If not to be pressed, the cut lengths are cooled before wrapping. In either case the cooled bars are automatically wrapped, cased and sent to storage, prior to shipping.

The detergent laundry bars made in accordance with this invention have acceptable washing and foaming properties for detergent laundry bars, and are of satisfactory hardness and are resistant to breakage. They are also better than laundry bars based on other detergents such as sodium higher fatty alcohol sulfate and sodium higher alkylbenzene sulfonate in storage properties and biodegradability, respectively. The various components of the laundry bars interact and contribute to the final desirable properties of the product in several ways, to produce the desired products.

The following examples are given to illustrate the invention but are not to be considered as limiting it. Unless otherwise indicated,in the specification and in the claims all parts and proportions are by weight.

EXAMPLE 1

Forty parts of Neodol 25-3S (a 70% solids content aqueous solution of the sodium salt of ethoxylated [3 ethylene oxide groups] $C_{12-15}$ fatty alcohol sulfuric acid) and 15 parts of finely divided (through No. 200 sieve, U.S. Sieve Series) bentonite (FILGEL, Philippines) are blended together in a conventional soap or detergent amalgamator or similar sigma blade mixer and mixing is continued until the bentonite is sufficiently hydrated that in combination with the ethoxylate sulfate detergent a semi-solid or solid product mix is formed, which breaks apart and recombines repeatedly during mixing. Such product may be milled or otherwise converted to smaller pieces of detergent-bentonite composition, useful for the manufacture of detergent laundry bars, but will often preferably be mixed with other components of the final desired detergent laundry bar composition in the same amalgamator immediately after solidification of the detergent solution. The described mixings are carried out at room temperature, about 20 to 25° C., and the heat of mixing might raise the product temperature about a degree Centigrade.

EXAMPLE 2

| Components | Percentages |
|---|---|
| Sodium higher fatty alcohol ethoxylate sulfate-water-bentonite (semi-solid)[1] | 55.0 |
| Sodium tripolyphosphate[2] | 12.0 |
| Sodium carbonate, anhydrous | 10.0 |
| Calcium carbonate, powdered (through No. 200 sieve, U.S. Sieve Series) | 10.7 |
| Talc, powdered (through No. 200 sieve, U.S. Sieve Series) | 11.0 |
| Sodium carboxymethyl cellulose | 0.5 |
| Pigment (white titanium dioxide, finely powdered) | 0.3 |
| Optical brightener (stilbene type) | 0.2 |
| Perfume | 0.3 |
| Water, deionized (to compensate for processing losses) | 1.5 |
| water loss in processing | 1.5 |
| | 100.0 |

[1]From Example 1.
[2]High in Phase I content, over 50% Phase I.

Detergent laundry bars of the formula given are made by a process which includes the steps of mixing, milling, plodding, cutting to lengths and (optionally) pressing to shape. Mixing is effected in a conventional soap or detergent amalgamator. The order of addition of the other components to the detergent-water-bentonite semi-solid starting material is not critical but it is highly desirable that the sodium tripolyphosphate, which is hydratable, be added near the end of the mixing, shortly before the milling or equivalent working. This is done to promote uniformity of hydration of the polyphosphate in homogeneous contact with other bar components, which helps to strengthen the final bar. In the mixing operation described, the various liquid components of the formula are first added to the detergent-bentonite materials in the mixer, followed by the particulate or powdered components. Mixing takes only a brief time, about five minutes, which is intentional so as to inhibit complete hydration of the polyphosphate. The mix made is in the form of a plurality of solid lumps, which are separable and which break apart during the mixing operation. The contents of the mixer are fed by a multi-worm conveyor to a five-roll mill of the Lehmann type, wherein the solid mix lumps are converted to ribbon and chip form. The multi-worm transfer conveyor is equipped with cooling means so as to prevent excessive sticking of the mixture to the conveyor parts.

The mill, which is also equipped with cooling means, operates at such a temperature that the final chip is at a suitable temperature, in the range of about 35° to 42° C., but in some instances higher or lower temperatures may be employed. The chip thickness is maintained in the range of 0.2 to 0.4 mm. The milled chips are then fed to a double stage vacuum plodder, which operates at a vacuum of about 700 mm. of mercury, to remove any entrapped air and to work the composition and extrude it as a bar through a heated nozzle, wherein the composition is heated sufficiently to facilitate extrusion as a homogeneous bar. The bar is then cooled to a suitable pressing temperature, preferably in the range of 20° to 30° C., and is pressed to final bar or cake shape, following which it is automatically wrapped, cased and sent to storage, for subsequent shipment and sale to the ultimate consumer. Alternatively, instead of being pressed to shape, the bars may be cut or essentially simultaneously cut and "printed" with a company name or other indicia, in which case the mentioned cooling may be effected after cutting and/or "imprinting".

The milling and plodding proceed well, with power requirements being substantially like those for manufacturing soap bars, and the bars made appear to be homogeneous. The bars are evaluated by expert evaluators and by consumers and are found to be of satisfactory utilitarian and aesthetic characteristics. Particularly, the bars are found to foam, refoam, and persist in foam satisfactorily, to feel good to the hands of the user, to clean well, to be sufficiently hard, and not to be consumed too quickly. Also, it is noted that the invented bars that are subjected to handling like that normally encountered in commercial distribution do not crack, break, powder or disintegrate so as to be unacceptable.

The foaming tests run to evaluate the invented bars accurately reflect actual use conditions of the present laundry bars. In actual use the items to be washed are wet and then are rubbed, on a washboard, with the laundry bar. After rubbing enough detergent composition into an item to be cleaned the item is rubbed on the washboard or other hard surface until any dirt, soil or stain is removed. It is then rinsed and sometimes is retreated. The washboard may be in a sink, pan, tub, pail, drum or other suitable container which will hold the wash water. After washing the first item of laundry, additional items may be wet in the wash water and then rubbed on the washboard, sometimes with the application of additional detergent composition from the laundry bar, and sometimes without such application. It is important to the consumer, and therefore it is important to the manufacturer, that in this second washing and in any further washings with the same wash water, the wash water will still generate a substantial amount of foam, as the laundry is moved through it, while the laundry is being rubbed on the washboard.

In a test devised to yield data corresponding to that from such hand washing processes, a pair of counter-oscillating washing machine-type agitators, but on a reduced scale, is mounted vertically and spaced apart, so as to agitate water in a plastic container that measures 34.3 cm. long×29.2 cm. wide×13.3 cm. high. A piece of towelling, such as a nubby face cloth, with holes cut in it to allow it to fit over vertical drive shafts for the agitators, rests on the tops of the agitators, each of which is of a generally flat truncated cone shape, with three equidistant vertical ribs. As the agitators move, the towelling twists and untwists, simulating the motions in the wash water of laundry being scrubbed. To start the test, three liters of a solution of the laundry bar being tested (or of the components of such a bar) are made, with the composition concentration being 2.5 g./1., and with the wash water used being of 300 p.p.m. hardness (mixed calcium and magnesium hardness, as $CaCO_3$). The foam height is measured after five minutes agitation, after which the water is allowed to rest for two minutes, with the height then again being read, and then agitation is resumed for another five minutes, and a third foam height reading is taken. By such tests it has been established that the foam height after refoaming is an excellent indication of the overall foaming capability of a product, including its initial and "after rest" foaming too. The product of this example, when tested as described, exhibits a refoaming height of about 7 cm., which is considered to be excellent.

EXAMPLE 3

In variations of Example 1 the FILGEL bentonite is replaced by other swelling bentonites, Mineral Colloid No. 101, AEG 325 and Laviosa AGB and the aqueous solution of ethoxylate sulfate detergent is mixed with the fifteen parts of the different bentonites. The products resulting are semi-solid intermediates, useful for the manufacture of the described detergent laundry bars. The bars from them, of formulas like that of Example 2 except for the bentonite, are of acceptable washing and foaming characteristics, comparable to those described for the product of Example 2.

In variations of this example the proportion of higher fatty alcohol ethoxylate (solid basis) to bentonite may be varied so that 15 to 40 parts of ethoxylate sulfate (solids basis) are mixed with 5 to 40 parts of bentonite, with the proportion of ethoxylate sulfate to bentonite being in the range of 1:1 to 4:1 and with the ethoxylate sulfate being in an aqueous solution containing 5 to 10 parts ethoxylate sulfate per 1 to 5 parts of water. Usually, the ethoxylate sulfate solution will be of 60 to 80% solids, with the balance being water. The products made are semi-solids, suitable for being converted to detergent laundry bars of this invention.

In other modifications of Examples 1 and 2, the ethoxylate sulfate is varied to be of a higher fatty alcohol of 10 to 18 carbon atoms, such as one derived from tallow and/or palm kernel oil, and is ethoxylated to contain 1, 5 and 9 ethoxy groups per mole. The Example 1 type products made are semi-solid, useful for the manufacture of acceptable detergent laundry bars of the type described in Example 2 and are satisfactory in detersive, foaming and storage stability characteristics. Similarly, satisfactory intermediate semi-solid products and final detergent laundry bars are obtainable when the sodium higher fatty alcohol ethoxylate sulfate solution is one which contains 60 to 80% of such ethoxylate sulfate, with the balance being water.

EXAMPLE 4 (comparative)

When the procedure of Example 1 is modified by substituting calcium carbonate for bentonite the product obtained remains fluid and is unacceptable for making detergent laundry bars by amalgamating with other constituents of such bars. When it is attempted to mill and plod compositions of the formula given in Example 2, with the substitution of calcium carbonate for the bentonite, the milled, plodded and extruded material resulting is too soft to be acceptable for pressing or other conversion to final bar or cake form. Similar negative results obtain when other water insoluble non-clay fillers are used instead of the bentonite.

EXAMPLE 5

When the percentages of the various components given in Example 2 are varied ±10%- and ±25%, while being maintained within the ranges described in the specification, useful detergent laundry bars are obtainable, which are of satisfactory detergency, foaming properties and hardness. Such is also the case when 3% of sodium silicate is present in the formula, replacing 3% of sodium carbonate. When talc is removed from the formula, being replaced by bentonite or calcium carbonate, its lubricity is lost but the product is satisfactory. When calcium carbonate is replaced by sodium tripolyphosphate a useful product of improved detergency is obtainable. When sodium carbonate is omitted, being replaced by sodium tripolyphosphate, the final product is also an acceptable detergent bar, as is that product resulting when up to ⅓ of the calcium carbonate is replaced by sodium sulfate in the formula of Example 2.

The invention has been described with respect to examples and illustrations thereof but is not to be limited to these because it is evident that one of skill in the art, with the present specification before him, will be able to utilize substitutes and equivalents without departing from the invention.

What is claimed is:

1. A built synthetic organic detergent laundry bar consisting essentially of 15 to 40% of higher fatty alcohol ethoxylate sulfate, 10 to 50% of builder(s) for the sodium higher fatty alcohol ethoxylate sulfate, 5 to 40% of bentonite, and 5 to 20% of water, which water includes water removable from any hydrate components of such detergent laundry bar when said bar is subjected to heating at 105° C. for two hours.

2. A built synthetic organic detergent laundry bar according to claim 1 wherein the higher fatty alcohol ethoxylate sulfate is sodium higher fatty alcohol ethoxylate sulfate, the higher fatty alcohol thereof is of 10 to 18 carbon atoms and the ethoxylate moiety is of 1 to 20 ethoxy group(s), the builder(s) for the sodium higher fatty alcohol ethoxylate sulfate is/are water soluble inorganic builder salt or a mixture of such salts, and the bentonite is in such a percentage that it contributes bodying properties to the laundry bar and softens materials washed with it.

3. A laundry bar according to claim 2 consisting essentially of 20 to 35% of sodium higher fatty alcohol ethoxylate sulfate in which the higher fatty alcohol is of 10 to 18 carbon atoms and the ethoxylate moiety is of 2 to 10 ethoxy groups, 5 to 35% of sodium tripolyphosphate, 0 to 25% of sodium carbonate, 0 to 10% of sodium silicate, 10 to 25% of bentonite and 8 to 15% of water.

4. A laundry bar according to claim 3 consisting essentially of 25 to 30% of sodium higher fatty alcohol ethoxylate sulfate in which the higher fatty alcohol is of a mixture averaging 12 to 16 carbon atoms and the ethoxylate moiety averages 2 to 5 ethoxy groups, 10 to 20% of sodium tripolyphosphate, 5 to 20% of sodium carbonate, 0 to 5% of sodium silicate, 10 to 20% of bentonite, 0 to 15% of talc, 5 to 20% of calcium carbonate and 10 to 15% of water, which bar is plodded.

5. A laundry bar according to claim 4 consisting essentially of 25 to 30% of sodium higher fatty alcohol ethoxylate sulfate in which the higher fatty alcohol is of an average of 12 to 15 carbon atoms and the ethoxylate moiety is of an average about 3 ethoxy groups, 10 to 15% of sodium tripolyphosphate, 13 to 17% of bentonite, 8 to 12% of sodium carbonate, 0 to 3% of sodium silicate, 5 to 15% of talc, 8 to 15% of calcium carbonate, and 11 to 14% of water, which bar is milled and plodded.

6. A laundry bar according to claim 5 consisting essentially of about 28% of sodium higher fatty alcohol ethoxylate sulfate in which the higher fatty alcohol is of an average of 12 to 15 carbon atoms and the ethoxylate moiety is of an average of 3 ethoxy groups, about 12% of sodium tripolyphosphate, about 15% of bentonite, about 10% of sodium carbonate, about 0% of sodium silicate, about 11% of talc, about 11% of calcium carbonate, and about 12% of water, which bar is milled, plodded and pressed.

7. A process for manufacturing a detergent laundry bar of the composition of claim 1 consisting essentially of mixing together proportions for said composition of higher fatty alcohol ethoxylate sulfate in aqueous solution or aqueous solution/dispersion, and bentonite, to convert such solution or solution/dispersion to semi-solid or solid form, mixing such bentonite-higher fatty alcohol ethoxylate sulfate-water mixture, in semi-solid or solid form, with the builder(s) for the higher fatty alcohol ethoxylate sulfate and additional water for processing, with an excess of water being present to compensate for water to be lost in subsequent processing, plodding the mixture, and extruding it in bar form.

8. A process according to claim 7 consisting essentially of mixing together 15 to 40 parts of sodium higher fatty alcohol ethoxylate sulfate, in aqueous solution or solution/dispersion containing from 5 to 10 parts of sodium higher fatty alcohol ethoxylate sulfate wherein the higher fatty alcohol is from 10 to 18 carbon atoms and the ethoxylate moiety is of 1 to 20 ethoxy groups, per 1 to 5 parts of water, with 5 to 40 parts of bentonite to produce such mixture in semi-solid or solid form, suitable for subsequent amalgamating, plodding and extruding in bar form to produce a detergent laundry bar.

9. A process according to claim 8 consisting essentially of mixing together an aqueous solution of about 28 parts of sodium higher fatty alcohol ethoxylate sulfate wherein the higher fatty alcohol is of an average of 12 to 16 carbon atoms and the ethoxylate moiety averages 2 to 10 ethoxy groups, and about 12 parts of water, with about 15 parts of bentonite to convert such solution to semi-solid or solid form, mixing such bentonite-sodium higher fatty alcohol ethoxylate sulfate-water mixture, in semi-solid or solid form, with about 12 parts of sodium tripolyphosphate, about 11 parts of talc, about 11 parts of calcium carbonate, and about 10 parts of sodium carbonate, milling and plodding the mixture, extruding it in bar form and cutting the bar to desired lengths.

10. A laundry bar according to claim 1 which was manufactured by mixing together the proportions for said bar of higher fatty alcohol ethoxylate sulfate in aqueous solution or aqueous solution/dispersion, and bentonite, which convert such solution or solution/dispersion to semi-solid or solid form, mixing such bentonite—higher fatty alcohol ethoxylate sulfate—water mixture, in semi-solid or solid form, with the proportion(s) of builder(s) for the higher fatty alcohol ethoxylate sulfate, with an excess of water being present to compensate for water to be lost in subsequent processing, plodding the mixture, and extruding it in bar form.

11. A built synthetic organic detergent laundry bar according to claim 10 wherein the higher fatty alcohol ethoxylate sulfate is sodium higher fatty alcohol ethoxylate sulfate, the higher fatty alcohol thereof is of 10 to 18 carbon atoms and the ethoxylate moiety is of 1 to 20 ethoxy group(s), the builder(s) for the sodium higher fatty alcohol ethoxylate sulfate is/are water soluble inorganic builder salt or a mixture of such salts, and the bentonite is in such a percentage that it contributes bodying properties to the laundry bar and softens the materials washed with it, and such bar is made by a process consisting essentially of mixing together 15 to 40 parts of sodium higher fatty alcohol ethoxylate sulfate, in aqueous solution or solution/dispersion, containing from 5 to 10 parts of sodium higher fatty alcohol ethoxylate sulfate wherein the higher fatty alcohol is from 10 to 18 carbon atoms and the ethoxylate moiety is from 1 to 20 ethoxy groups, per 1 to 5 parts of water, with 5 to 40 parts of bentonite, to produce such mixture in semi-solid or solid form, and amalgamating, plodding and extruding such composition in bar form.

12. A laundry bar according to claim 11 consisting essentially of about 28% of sodium higher fatty alcohol ethoxylate sulfate in which the higher fatty alcohol is of an average of 12 to 15 carbon atoms and the ethoxylate moiety is of an average of 3 ethoxy groups, about 12% of sodium tripolyphosphate, about 15% of bentonite, about 10% of sodium carbonate, about 0% of sodium silicate, about 11% of talc, about 11% of calcium carbonate and about 12% of water, which bar is made by a process consisting essentially of mixing together an aqueous solution of about 28 parts of sodium higher fatty alcohol ethoxylate sulfate wherein the higher fatty alcohol is of an average of 12 to 15 carbon atoms and the ethoxylate moiety averages about 3 ethoxy groups, and about 12 parts of water, with about 15 parts of bentonite, to convert such solution to semi-solid or solid form, mixing such bentonite—sodium higher fatty alcohol ethoxylate sulfate—water mixture, in semi-solid or solid form, with about 12 parts of sodium tripolyphosphate, about 11 parts of talc, about 11 parts of calcium carbonate, and about 10 parts of sodium carbonate, milling and plodding the mixture, extruding it in bar form and cutting the bar to desired lengths.

13. A process for converting an aqueous solution or solution/dispersion of higher fatty alcohol ethoxylate sulfate in water to semi-solid or solid form, suitable for amalgamating with other detergent laundry bar components and subsequent milling, plodding and extruding in bar form, to produce a detergent laundry bar, which comprises mixing together 15 to 40 parts of higher fatty alcohol ethoxylate sulfate wherein the higher fatty alcohol is of 10 to 18 carbon atoms and the ethoxylate moiety is of 2 to 10 ethoxy groups, in aqueous solution or solution/dispersion containing 5 to 10 parts of higher fatty alcohol ethoxylate sulfate per 1 to 5 parts of water, with 5 to 40 parts of bentonite, to produce such mixture in semi-solid or solid form, suitable for amalgamating-,milling, plodding and extruding in bar form to produce a detergent laundry bar.

14. A process according to claim 13 wherein the higher fatty alcohol ethoxylate sulfate is sodium higher fatty alcohol ethoxylate sulfate inwhich the higher fatty alcohol is of an average of 12 to 16 carbon atoms and the ethoxylate moiety is of an average of 2 to 5 ethoxy groups, the sodium higher fatty alcohol ethoxylate sulfate is in aqueous solution which contains 60 to 80% of such ethoxylate sulfate and 40 to 20% of water, and the proportion of such ethoxylate sulfate, from the aqueous solution, to bentonite, is in the range of 1:1 to 4:1.

* * * * *